US005795061A

United States Patent [19]

Perlman

[11] Patent Number: 5,795,061

[45] Date of Patent: Aug. 18, 1998

[54] VORTEX MIXING IMPLEMENT FOR SAMPLE VESSELS

[75] Inventor: Daniel Perlman, Arlington, Mass.

[73] Assignee: Brandeis University, Waltham, Mass.

[21] Appl. No.: 818,600

[22] Filed: Mar. 14, 1997

Related U.S. Application Data

[63] Continuation-in-part of Ser. No. 590,552, Mar. 19, 1996, abandoned.

[51] Int. Cl.[6] ..... B01F 13/00

[52] U.S. Cl. ..... 366/130; 366/208; 366/342; 206/219

[58] Field of Search ..... 366/213, 208, 366/348, 343, 217, 209, 214, 218, 130, 342; 206/219, 220; 422/102, 101; 436/177, 174

[56] References Cited

U.S. PATENT DOCUMENTS

| | | | |
|---|---|---|---|
| 2,286,600 | 6/1942 | Chott | 366/602 |
| 2,710,742 | 6/1955 | Vlock | 366/602 |
| 3,985,649 | 10/1976 | Eddelman | 366/273 |
| 4,062,652 | 12/1977 | Rolfo-fontana | 366/273 |
| 4,214,874 | 7/1980 | White | 366/273 |
| 4,514,091 | 4/1985 | Kaspar et al. | 366/208 |
| 4,555,183 | 11/1985 | Thomas | 366/208 |
| 5,082,632 | 1/1992 | Gross et al. . | |
| 5,084,240 | 1/1992 | Babson . | |
| 5,246,670 | 9/1993 | Haber et al. . | |
| 5,272,092 | 12/1993 | Hamasaki et al. | 366/273 |

*Primary Examiner*—Tony G. Soohoo
*Attorney, Agent, or Firm*—Lyon & Lyon LLP

[57] ABSTRACT

A method for improving the efficacy of vortex-mixing a liquid sample, in which a mixing implement and the sample are placed inside a microcentrifuge tube or sample vessel. The presence of the upright mixing implement in the tube or vessel does not substantially interfere with centrifugal fractionation of the sample. The method includes the steps of providing a rod or straight wand-shaped mixing implement, in which the length of the mixing implement is greater than the maximum inner diameter of the vessel but less than the maximum inner height of the vessel when sealed so that the mixing implement is constrained to remain substantially upright within the vessel. The surface of the mixing implement is configured and arranged to be free of any substantial depressions and concave blemishes which could trap sedimenting solid material in the sample during centrifugation. The sample and mixing implement are placed in the vessel, and the vessel positioned in a holder and/or adapter element of a vortex-mixing machine. Vortex-mixing is commenced and the mixing implement moves and/or gyro-rotates rapidly around the inner sidewall of the vessel thereby accelerating the mixing process.

19 Claims, 2 Drawing Sheets

FIG. 1
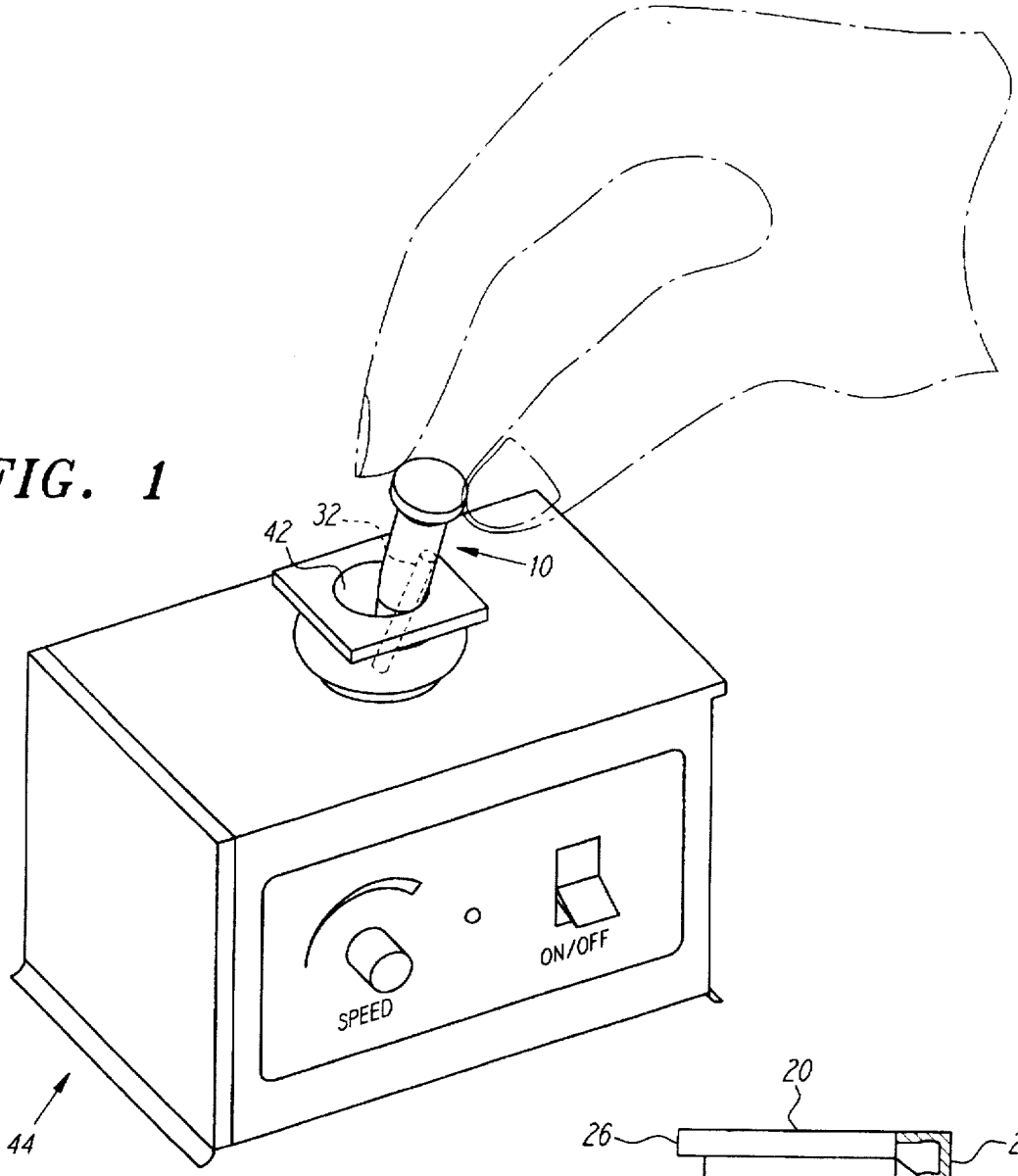
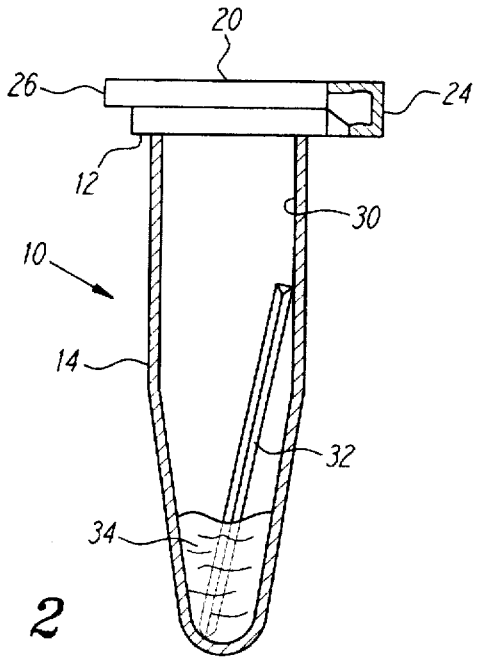
FIG. 2

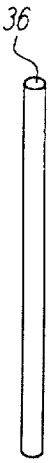
FIG. 3a
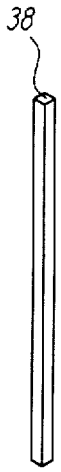
FIG. 3b
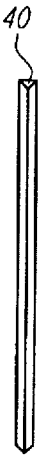
FIG. 3c
FIG. 4
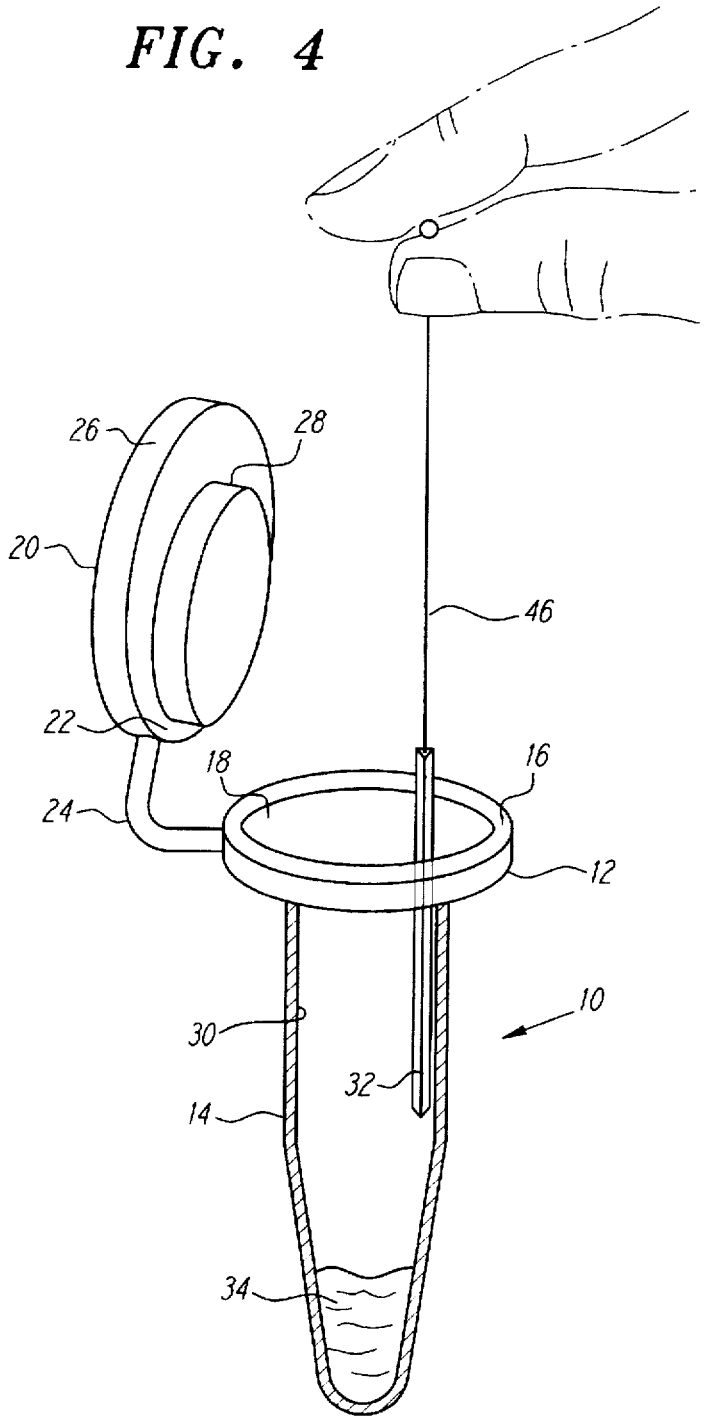

VORTEX MIXING IMPLEMENT FOR SAMPLE VESSELS

RELATED APPLICATIONS

This application is a continuation-in-part of co-pending application Perlman, VORTEX MIXING IMPLEMENT FOR MICROCENTRIFUGE TUBES, U.S. patent application Ser. No. 08/590,552, filed Mar. 19, 1996, now abandoned, which is hereby incorporated by reference in its entirety including drawings.

BACKGROUND OF THE INVENTION

This invention relates to the use of a mixing implement during vortex-agitation of a laboratory sample, the implement functioning to accelerate the mixing of liquids and/or dispersal of solids contained within a laboratory microcentrifuge tube or sample vessel, and while in place, not interfering with centrifugal fractionation of the sample.

Microcentrifuge tubes, also known as microtubes, are small plastic vessels which are typically tapered and closed at one end, and have a conical or rounded bottom. The polyethylene or propylene tubes are generally capable of holding between 0.2 and 2.0 ml of liquid, and are constructed to withstand forces typically in excess of 10,000 times their own weight (10,000×g) during centrifugation. These tubes are used widely in biotechnology laboratories as vessels for mixing and reacting chemical substances, separating and purifying liquid and solid materials by centrifugation, handling radioisotope chemicals, storing biochemicals, and containing, mixing, or incubating contaminant-free samples. They have tight-fitting hinged or screw-top lids whose size and shape protect, cover, and hermetically seal the perimeter of the tube opening, and help maintain the inside of the tube in an aseptic condition.

Vortex-agitation is a process of rapid gyro-rotary mixing of a liquid sample in a container such as a test tube or microtube as described above. Liquid flow during vortexing is generally circular in direction around the major vertical axis of a container, such as test tube Vortexing is typically accomplished by placing the bottom of the tube into the cup-shaped rubber adapter portion of an electrically powered vortexing machine which, when activated, initiates gyratory motion of the rubber cup. Vortexing is often used to agitate small volumes of liquid held in plastic microtubes. These volumes are limited by the capacity of the commercially available microtubes which currently can hold up to approximately 2.0 milliliters. The practice of vortexing substances in microtubes is used in a wide variety of applications such as dissolving reagents, resuspending pellets (produced by centrifugation of particulate suspensions such as bacterial or eucaryotic cells or adsorbent materials, etc.), emulsifying liquids (during solvent extraction, protein denaturation and removal, etc.) and for many other mixing applications. Typical microtubes with tapered, conically-shaped lower portions are convenient for centrifugation but because the lower portion is narrow near the bottom, it can be difficult to achieve rapid motion of liquid for resuspending sedimented material, etc. during vortexing. Yet vigorous agitation is required for resuspension of cell pellets, dissolution of solutes, emulsification of liquids, and the like.

Several mechanical stirring and mixing devices are in current laboratory use for producing movement of liquids and solids in small vessels. These devices include a motorized, magnetically driven magnetic stirring bar, a manually rotated stirring rod for test tubes and an electrically driven propeller stirrer. The magnetic stirring bar rotates horizontally against the bottom of a flat-bottomed vessel and produces a rotational flow of a liquid. The test tube stirring rod and the propeller stirrer are operated by external shafts which extend upward beyond the lip of the vessel. None of these devices has any relevance for improving the process of vortex-mixing of samples. Applicant is, however, familiar with the addition of small glass beads to liquid suspensions of cells in test tubes to promote cell breakage by vortexing. When utilized in a microcentrifuge tube for mechanical agitation, the above devices are routinely removed from the tube prior to centrifugation to allow normal pellet formation if suspended solid material is present.

Another type of mixing device is described in Kaspar et al., CONTAINER ASSEMBLY FOR VISCOUS TEST SPECIMENS MATERIALS, U.S. Pat. No. 4,514,091, Issued Apr. 30, 1985. A homogenization rod having a generally helical or coil shape is described. The rod is designed to dislodge material from a specially formed cavity in the underside of the top cover of a container, which is also described, as the container is agitated back and forth along its longitudinal axis in a generally reciprocal motion, markedly different from the high speed circular flow generated by vortex agitation.

SUMMARY OF THE INVENTION

Prior to the present invention, Applicant could find no convenient means to improve the efficiency of the vortexing process as routinely used for emulsifying liquids and resuspending or dissolving solid materials in small sealed laboratory vessels such as microtubes, vials, and the like. In particular, Applicant observed that while vortexing could be used to induce rapid circular motion of liquids, the efficiency of mechanical disruption of solids and the efficiency of resuspending sedimented samples adhered to the sidewalls of a vessel were limited. The addition of a small amount of glass beads for sample agitation was considered and ruled out because of the inconvenience of subsequently removing the beads from the sample and because of the loss of sample material within the mass of beads. Likewise, the helical rod device of Kaspar et al. was not suitable for vortex agitation because it tends to roll around the inner wall surface of the tube rather than scraping the wall, and because the helix structure tends to embed itself within sedimented material on the lower sidewall of the centrifuge tube.

To improve vortexing efficiency (mixing, mechanical disruption of suspended and adhered solid materials, and multi-directional flow of liquids), Applicant has experimented with the addition of single objects of different shapes as vortex-mixing implements or agitators. These agitators have included regularly and irregularly shaped balls, blocks, pyramids, etc. fabricated from glass or plastic. An unexpected problem was discovered during experimental trials with each of these agitators. As the vortexing speed increased, each agitator was propelled upward toward the lid of the microtube or vial, rather than remaining near the bottom of the vessel where it was needed for mechanical contact and displacement of solid material. To solve this problem, applicant has devised a geometry for the agitator which maintains the agitator in a substantially vertical (upright) orientation in the microtube during vortexing, but at the same time does not substantially restrict its motion or speed which is required for its effectiveness as a mixer. Accordingly, Applicant has found that a tall rod or straight wand-shaped plastic agitator whose length is greater than the maximum inner diameter of the microtube but less than the maximum inner height of the tube is an effective vortexing device. The device (hereinafter termed a mixing implement or vortex agitator or vortex implement) can be configured with an approximately round, triangular, square or even polygon cross-section. During vortexing, as the vortex agitator is accelerated around the inner perimeter wall of the microtube and begins to climb the sidewall, it is blocked or deflected by the underside of the vessel's lid, e.g., the microtube lid.

In connection with the vortex mixing implements, the term "straight" indicates that there are no significant bends within the implement, while the term "substantially straight" means that, for example, the ends of the implement may be rounded or there may be a small symmetrical curvature to the exterior of the implement along the longitudinal axis creating a slightly convex exterior as seen in a longitudinal cross-section. The implements of this invention do not include objects having greater than about 10 degrees of curvature to the longitudinal axis of the object, and thus do not include coils, circles, and C- or U-shaped objects. Preferably the implements of this invention are straight, but usually substantially straight implements may also be used.

Thus, the term "rod" or "wand" refer to an object which is straight or substantially straight.

"Substantially upright" means that the mixing implement forms an angle of less than 90 degrees to the longitudinal axis of a vessel, preferably less than 70 degrees, more preferably less than 45 degrees, and still more preferably less than 30 degrees. Thus, the implement cannot invert about its long axis within the tube, or bind and lodge by bridging across the inner diameter of the vessel.

As described below, a straight implement is able to provide effective vortex mixing. The rod or straight wand shape allows the object to gyro-rotate in a high speed circular motion while also having sufficient freedom to migrate up and down within the sample vessel, thereby scraping the side wall of the sample vessel. It was found that such action, especially such wall scraping action, is not provided by other tested implements which are not substantially straight wand or rod shaped objects, such as the helical rod of Kaspar et al. In addition, the straight wand or rod shape allows the implement to remain in a vessel, such as a microcentrifuge tube during centrifugation without substantially interfering with pellet formation or sediment retention. The straight rod typically contacts only the very bottom of the tube and the upper sidewall, rather than the lower sidewall where centrifugal pellet formation occurs, thereby bridging over a pellet. Thus, the straight shape and smooth exterior of the implement allows a pellet to form and/or the implement to be removed from a vessel following centrifugation with no or little disturbance of a pellet in that vessel.

For the vortex agitator to achieve speed and mobility which are important to its efficacy, it is important that the vortex agitator be neither to large nor too heavy in relationship to the microtube or other similar vessel. Accordingly, the volume of the vortex agitator should not exceed 20%, and preferably 10% of the volume of the vessel. The weight of the agitator is preferably, similarly scaled to the aqueous sample capacity of the vessel. For example, a very effective polypropylene vortex agitator having a 2 mm diameter and 2.2 cm length has been fabricated for use in a 1.5 ml capacity microtube. Its approximate volume and weight are 0.070 ml and 0.063 gm representing approximately 4–5% of the volume and aqueous weight capacity of the microtube. A similarly effective but smaller agitator having a 1.3 mm diameter and 1.4 cm length has been fabricated for use in a 0.5 ml capacity microtube. Its volume corresponds to approximately 4% of the volume of the microtube.

In a conical-bottomed tube it is often useful for the bottom of the agitator rod to move, i.e., migrate, up and down over the conical inner wall of a tube as the rod is rotating and revolving at high speed around the axis of the tube, so as to contact any solid material such as sedimented cells, DNA, RNA protein, etc. on this inner wall portion and help in dislodging the material. Accordingly, the length of the vortex agitator is ideally equal to or shorter than 95% of the maximum inner height of the sealed tube to allow this upward and downward displacement motion of the agitator during vortexing. However, by making the length of the agitator at least 50% of the inside height of the sealed microtube, there is overlapping coverage of the inner wall surface of the microtube by the agitator as it gyrates and moves up and down inside the microtube, alternately in contact with the bottom and then the lid's underside. Accordingly, the length of the vortex agitator is most preferably between 50% and 95% of the maximum inner height of the sealed microtube. The vortex agitator can be used in liquid(s) either with or without solids or pelleted material present. Used with a microtube, the vortex agitator is dropped into the vessel along with other substances. During vortexing, the agitator moves rapidly around the inner perimeter wall of the microtube, generally at a different speed than the liquid. The combination of the agitator's rotation and gyration (gyro-rotation), and its promotion of turbulent liquid flow, accelerates essentially any mixing process such as dissolution of solids and liquid emulsification within the microtube. Moving contact between the vortex agitator and the sidewall of the microtube is particularly useful in dislodging and resuspending solids located on the bottom and on the sidewall of the microtube such as pellets of centrifuged cells and macromolecules as described above. In addition, because the vortex agitator remains upright in the microtube, it may be easily removed following use (see FIGS. 2 and 4 below), and does not interfere with centrifugation of emulsions, suspensions, etc. or the concomitant formation of sedimented pellets. For example the surface of the agitator is free of any substantial concave blemishes or other depressions which could trap rather than shed sedimenting solids and interfere with centrifugation of suspensions of various materials.

Applicant has compared the rate of resuspending identically sedimented pellets of *Escherichia coli* cells in 1.5 ml capacity microtubes (resuspending 1.0 ml of sedimented stationary growth phase *E. coli* cells into 0.10 ml of isotonic saline), both in the presence and absence of a vortex agitator of the present invention. While achieving complete resuspension of the cells by vortexing without the vortex agitator required 45–60 seconds, the presence of the vortex agitator reduced the cell resuspension time to as little as 10 seconds. Similar very substantial reductions in required vortexing time have been measured for emulsification of liquids, dissolution of salts, and other mixing procedures regularly carried out in microtubes and other small vessels using the vortexing method.

Thus, in a first aspect, the invention features a method for improving the efficacy of vortex-mixing a liquid sample and/or dispersing solids by utilizing a mixing implement, the mixing implement, while in place, not interfering with centrifugal fractionation of that sample. The method involves placing a mixing implement in a microcentrifuge tube or similar sample vessel (the microcentrifuge tube and sample vessel collectively termed "vessel") along with the sample. The presence of the upright mixing implement in the tube does not substantially interfere with centrifugal fractionation of the sample. The method includes the steps of providing a rod or straight wand-shaped mixing implement in which the length of the mixing implement is greater than the maximum inner diameter of the vessel but less than the maximum inner height of this vessel when sealed so that the mixing implement is constrained to remain substantially upright within the vessel. The mixing implement is configured and arranged to shed, i.e. release, any sedimenting solid material contained in the liquid sample which may be propelled onto the mixing implement during centrifugation. More specifically, the surface of the implement is free of any substantial depressions, concave blemishes, and the like which would receive and trap sedimenting material during centrifugation. The sample and the mixing implement are placed in the vessel which is then positioned in a holder and/or adapter element of a vortex-mixing machine. Vortex-mixing is then commenced, and the mixing implement moves and/or gyro-rotates rapidly around the inner sidewall of the vessel thereby accelerating the mixing process.

In preferred embodiments, the method additionally includes the steps of placing the microcentrifuge tube or vessel containing the sample and the mixing implement into a suitably configured and sized centrifuge rotor, and centrifuging and fractionating the sample. During centrifugation, the mixing implement sheds, i.e. releases any sedimenting solid material which may be propelled onto this mixing implement during centrifugation.

In another preferred embodiment, the length of the mixing implement is between 50% and 95% of the maximum inner height of the vessel when sealed, and the surface of the mixing implement is free of any substantial depressions such as concave blemishes which may trap sedimenting solid material contained in said sample, where the solid material may be propelled onto the mixing implement during centrifugation.

In still another preferred embodiment, after the sample and mixing implement are placed in the vessel, the vessel is sealed using a closure selected from the group consisting of a hinged lid, a screw cap, a plug seal, and a flexible covering material.

In other preferred embodiments, the rod or straight wand-shaped mixing implement is formed from a material selected from the group consisting of a thermoplastic resin, glass, metal, and composite resin. These materials provide appropriate rigidity, strength, and density for a variety of applications. This allows the implement to remain intact and undeformed during vortex mixing. In addition, these materials can be conveniently fabricated into vortexing implements. Within the category of thermoplastics, the implement can be formed from either a polyolefin, polycarbonate, polystyrene, acrylic, or a polyester material. Within the polyolefin category, either polypropylene or high density polyethylene can be selected. The method of manufacture for the mixing implement is preferably either extrusion molding or injection molding. The cross-sectional shape of the mixing implement can be selected to be either round, oval, triangular, square, or polygon. The cross-sectional shape can be selected to provide varying levels of turbulence and/or wall scraping effects during vortex mixing. The length of the mixing implement is between approximately 0.5 and 1.5 inches for use in a microcentrifuge tube whose maximum inner diameter is approximately 0.4 inch and whose maximum inner height is approximately 1.6 inches. In use, the implement of this embodiment is thereby maintained in a substantially upright position but allowed to move longitutinally. The mixing implement is useful in microcentrifuge tubes having a volume capacity ranging from approximately 0.2 to 2 milliliters. The volume of the mixing implement does not exceed 20%, and preferably is less than 10% of the volume of the vessel.

In a further embodiment, the method of this invention also involves removing the mixing implement described above from the vessel using an extraction device which allows removal of the implement while preventing contamination of the liquid and/or substantial disturbance of solid material sedimented during subsequent centrifugation. The "preventing contamination" may involve preventing the contamination of the sample with foreign microbes by providing a clean sterile extraction device adapted to allow aseptic removal of the mixing implement from the vessel. The extraction device is preferably inexpensive and may be discarded after use. Preferably, the extraction device is a straight pin or other sharp object which can be used to spear the mixing implement and lift it from the vessel, so that the method further involves spearing the mixing implement with the extraction device. Alternatively, the extraction device is an inexpensive hollow plastic straw which, when slid over the implement, captures the implement within its hollow bore, or is a magnet and the plastic mixing implement is fabricated using a ferromagnetic additive within the thermoplastic resin material such as iron, nickel, cobalt, or some combination of these metals which is attracted to this magnet allowing the implement to be removed from the vessel. In this alternative, the method involves removing the implement by magnetically attracting the implement to the extraction device and lifting the implement out of the vessel. Contamination can be prevented by using a sterilized magnet or using a sufficiently strong magnet that the implement can be removed without contacting the surface of the sample with the magnet. As a second alternative, the mixing implement can be injection-molded and configured to integrally include a semi-flexible plastic extension which protrudes out of the microtube (as an elastic spring) only when the microtube lid is opened to provide a "handle" to remove the implement by hand or by tweezers. In this second alternative, the length of the mixing implement including the semi-flexible extension is selected to be greater than the inner height of the microtube to allow easy and convenient removal of the implement. In this way, the mixing implement can be removed, while preventing contamination, by hand or using a tool (e.g., tweezers) to grasp the "handle" above the surface of the sample.

In relation to preventing contamination of a sample in the present method, "foreign microbes" refers to microbes introduced into a sample in a vessel from outside the vessel when the introduction is not intentional. The microbes may be of the same species and strain or different. Microbe has its usual biological meaning. Thus, in embodiments of the present invention, the step of removing the mixing implement can be performed without unintentionally introducing microorganisms, such as by organisms carried into the sample on an extraction device.

In a related aspect, the invention also provides a microcentrifuge tube or sample vessel which has within it a straignt wand shaped mixing implement as described above. Thus, the length of the implement is greater than the maximum inner diameter but less than the maximum inner height of the tube or vessel, so that the implement is constrained to remain substantially upright. The surface of the implement is configured and arranged to be free of substantial depressions or concave blemishes which could trap sedimenting material during centrifugation.

In another related aspect, the invention provides a kit for improving the effeciency of vortex mixing of a sample as described in the method above. The kit comprises a microcentrifuge tube or sample vessel and a straight wand shaped mixing implement as described above Other features and advantages of the invention will be apparent from the following description of the preferred embodiments, and from the claims.

DESCRIPTION OF THE PREFERRED EMBODIMENTS

The drawings will first be briefly described.

Drawings FIG. 1 is a perspective view, partially in section, of a microcentrifuge tube, vortex-mixing implement, liquid sample, and vortex-mixing machine of this invention.

FIG. 2 is a longitudinal sectional view of the tube, implement and sample shown in FIG. 1.

FIG. 3 is a perspective view of round, square and triangular vortex-mixing implements.

FIG. 4 is a perspective view, partially in section, of an extraction device (straight pin) being used to remove a vortex-mixing implement from a microcentrifuge tube.

Referring to the Figures, microcentrifuge tube 10 (approximate length 1½ inches and approximate diameter 7/16 inch) is typically injection-molded from virgin polypropylene or polyethylene with lip flange 12 which can be used to support the tube in a microcentrifuge rotor or in a storage rack. Generally, the microcentrifuge tube includes a container 14 having an upper perimeter wall surface 16 (defining an upper opening 18) adapted to mate with the lower surface 22 of lid 20. Lid 20, includes lid hinge 24 and lid lifting tab 26 for opening the container 14 with either a fingernail or a container opener tool. Annular lid seal 28 (on the underside of the lid 20) provides and establishes a watertight hermetic friction-seal with the inner perimeter wall surface 30 of container 14. According to the present invention, mixing implement 32 and liquid sample 34 are placed in container 14. Different shaped mixing implements (straight extrusions with different cross-sections, see FIG. 3) are fabricated to establish different modes and degrees of agitation. Round 36, square 38 and triangular 40 cross-section implements are shown in FIG. 3. Mixing implements with sharp corners tend to produce stronger agitation than round and oval-shaped implements. Polypropylene homopolymer resins (such as Pro-Fax PD-191 from Montell USA, Inc., Wilmington, Del.) and polypropylene copolymer resins (such as Pro-Fax 7823, also from Montell USA, Inc.) which have low melt flow rates (0.4–0.8 dg/min, defined by ASTM Method D1238) are useful for extrusion-fabrication of the presently described mixing implements.

In the practice of the present invention, a single clean and/or sterile vortex mixing implement 32 (held in a polyethylene bag or other holding device containing one or more such mixing implements) is dispensed into the container 14 of microcentrifuge tube 10. A liquid sample 34 is also placed in the same microcentrifuge tube 10. Lid 20 is closed and sealed, and tube 10 is placed in rubber vortexing cup 42 of vortex machine 44 (see FIG. 1). Tube 10 in cup 42 is either hand-held or held by a mechanical adapter device (not shown) which accommodates several tubes simultaneously. As the gyro-rotary motion of cup 42 commences, mixing implement 32 is accelerated rapidly around the inner perimeter wall surface 30 of container 14 and, while moving in this gyro-rotary manner, also tends to move upward until it contacts the underside of lid 20 and may then move downward again. During this up and down, and circular cycle of motion, mixing implement 32 contacts most or all of the inner perimeter wall surface 30 of container 14, and thereby helps scrape away, resuspend and/or redissolve solid material which lies on, or has been sedimented against this wall surface 30. Likewise, mixing implement 32 can be used to accelerate emulsification of liquids, extraction of solutes from one liquid phase to another, denaturation of macromolecules or any other process which depends upon vigorous mixing of one or more liquid phases or mixing of suspensions of solid(s) in liquid(s). After vortexing has been completed, mixing implement 32 can be aseptically lifted and removed, i.e., extracted, from container 14 with a clean and sterile straight pin 46 which is first pushed into the end of this implement 32 (see FIG. 4). Alternatively, a clean sterile disposable plastic straw whose inner diameter is slightly larger than the diameter or cross-sectional span of the mixing implement 32 can be conveniently slid over the upper portion of the implement and then withdrawn from tube 10 carrying implement 32 within the hollow bore of the straw (not shown). The inner diameter of the straw is sized to provide a slight friction fit with the outside of the mixing implement.

In preferred configurations for microcentrifuge tubes, the vortex mixing implement or agitator device is generally rod or straight wand-shaped. It is inexpensive to fabricate using the extrusion-molding method, and may be discarded after use. For typically sized 0.5 ml–2.0 ml capacity microcentrifuge tubes, the mixing implement consists of a solid extruded length of plastic (such as polypropylene or polyethylene) between approximately one-half and two inches in length. It is advantageous for the implement to have a length of between approximately 50% and 95% of the maximum inner height of the sealed vessel. Specifically, if the implement is at least 50% of the sealed vessel's inner height, and the implement gyrates in both the upward and downward positions in the vessel (i.e., gyrates on the bottom and then against the top of the vessel), one can usually achieve contact during the course of the vortexing procedure, between the implement and all of the inside wall surfaces of the vessel. This is useful, for example, in dislodging and resuspending sedimented material in a microtube. The implement may have a round, triangular, square, or polygon cross-section (between approximately 0.02 and 0.20 inches in diameter, or as the side dimension for a triangle, square or polygon cross-section). A pentagonal cross-section implement has been found to be particularly useful in rotating somewhat more freely than a triangular cross-section implement, while shedding sedimented material somewhat more readily than the square cross-section implement. The surface of the implement should be free of any significant physical depressions such as concave blemishes which could trap sedimenting solid materials during centrifugation. For 1.5 milliliter capacity microtubes, for example, a polypropylene agitator rod having a length of approximately ⅞ in. and a diameter of 0.08 in. has been found to be useful, while for 0.5 milliliter capacity microtubes a similar rod having a length of approximately 9/16 in. and a diameter of 0.05 in has been found useful. Manufacture of the agitators using a low melt-flow rate polymer with a continuous extrusion and coupled transverse cutting process is preferred. Injection-molding using a higher melt-flow rate polymer provides an alternative manufacturing method. Fabrication of the agitators using a thermoplastic resin such as a polyolefin (polyethylene or polypropylene) which can withstand organic solvents and caustic agents is desirable to allow their use in a broad range of chemical environments. For example, improved vortex-agitation may be desirable during many mixing procedures such as chemical dissolutions or precipitations, chemical extractions, and biochemical denaturations with organic solvents and caustic agents including but not limited to alcohols, ketones, ethers, alkanes, aromatic solvents, chlorinated hydrocarbon solvents, strong acids, and alkaline reagents. It is also preferred that the vortex agitators withstand either sterilization by steam-autoclaving at a temperature of approximately 121° C., gamma ray irradiation, or exposure to a biocidal gas such as nitrous oxide. In this regard, commercially available grades of polypropylene can withstand each of these sterilization methods. Fabrication utilizing a thermoplastic resin such as polymethacrylate or polycarbonate which is more dense than water may be sometimes preferred over a polyolefin (typical density=0.9). For example, when vortexing an aqueous sample whose depth is similar to or greater than the height of the agitator, use of the denser resin allows the agitator to sink and agitate the bottom of the aqueous solution.

The present invention features an improved method for vortexing a liquid sample. The method includes providing a mixing implement or agitator device as described above; placing the implement in an appropriate vessel, e.g., a microtube, together with a sample to be vortexed; sealing the vessel with an appropriate lid or other closure if available; and subjecting the vessel, mixing implement, and sample to vortexing using a suitable gyro-rotary machine.

The length and cross-sectional shape of the vortex agitator alter the dynamics of liquid mixing within the microtube. As explained above, during vigorous vortexing of a microtube, a vortex agitator rod tends to move upward along its longitudinal axis to the top of the microtube. The maximum distance the rod can rise above the bottom of the microtube is determined by the difference in length between the rod and the inside height of the microtube. Upward and downward axial movement of the agitator, coupled with its rapid rotation and precession in the tube during liquid vortexing helps in dislodging pellets and resuspending or dissolving other solids in the microtube. With consideration to the geometry of the agitator rod, both round, triangular, square, and polygon cross-sections appear to be valuable alternatives. Agitators with angular corners appear to be especially useful in dislodging materials which are attached to the sidewalls of vessels. Agitator lengths ranging between approximately one-half and two-thirds the inner height of the sealed microtube appear to be particularly useful. Substantially shorter vortex agitators may be less useful for mixing, particularly when such agitators tend to be propelled to the top of the microtube where they are ineffective in dislodging pelleted material near the bottom of the tube. Likewise as previously pointed out, small spherical, ovoid, or block-shaped agitators tend to be propelled toward the top of the microtube during vortexing.

The presently described vortex agitator physically scrapes the inner sidewall of a container and perturbs simple circular liquid flow during vortexing. Such perturbation causes chaotic liquid movement and improves overall liquid mixing. In contrast to a magnetic stirring bar which is generally disposed horizontally during use and is restricted to movement on the bottom surface of a container nearest the magnetic driver table, the vortex agitator however, is generally vertically disposed and moves throughout the entire column of liquid in the container. Furthermore, the vortex mixing implement maintains at least intermittent contact while vigorously scraping portions of the inner sidewall in both the lower and upper half of the vessel when a sample is vortexed to dislodge sedimented material in the vessel. Comparing the method of using and propelling the present vortex agitator with that of a conventional stirring rod, the agitator is untouched by any external device and may be maintained sterile during use. Furthermore, while the vortex agitator promotes extreme agitation of a liquid, and is propelled by applying a generally circular vortex force to a container, the conventional stirring rod is typically used to promote gentle mixing of substances in a test tube, is propelled by hand or machine contact, and may be difficult to maintain in sterile condition.

For removing a vortex agitator from a microtube following its use, Applicant has found that a straight pin (preferably having an easily grasped head), other sharp pointed object, or a hollow plastic straw may be conveniently used. The pin is pushed into the end of the agitator allowing it to be lifted out of the microtube. Remarkably however, during most sample manipulation procedures including centrifugation and liquid recovery, the vortex agitator need not be removed from the microtube. For example, we have shown that normal centrifugal pellet formation occurs (on the lower sidewall of the microtube), and normal centrifugal liquid phase separation proceeds while the vortex agitator present in the microtube. The rod or straight wand-shaped agitator tends to bridge above the forming pellet during centrifugation, so that the disturbance of the pellet is absent, or at least minimized, during subsequent agitator removal or other manipulations.

Research into the unit cost for domestic production of the above-described polyolefin vortex agitators in commercial quantities (using the extrusion method for manufacturing) shows that they are cost-effective, i.e., less than one-half cent each. This modest cost will allow them to be used once and discarded if appropriate.

Other features and embodiments are within the following claims.

What is claimed is:

1. A method for improving the efficacy of vortex-mixing a sample comprising a liquid, and not interfering with subsequent centrifugation of said sample, wherein a mixing implement and said sample are placed inside a microcentrifuge tube or sample vessel, and wherein following vortex-mixing of said sample, the presence of said mixing implement in said vessel does not substantially interfere with fractionation of said sample by centrifugation, comprising the steps of:

providing a straight wand-shaped mixing implement, wherein the length of said mixing implement is greater than the maximum inner diameter of said vessel but less than the maximum inner height of said vessel when sealed, so that said mixing implement is constrained to remain substantially upright within said vessel, and wherein the surface of said mixing implement is configured and arranged to be free of substantial depressions and concave blemishes which could trap sedimenting solid material contained in said sample during centrifugation, placing said sample and said mixing implement in said vessel, positioning said vessel in a holder and/or adapter element of a vortex-mixing machine, and commencing said vortex-mixing, wherein said mixing implement moves and/or gyro-rotates rapidly around the inner sidewall of said vessel to accelerate the mixing process.

2. The method of claim 1 further comprising the steps of inserting said vessel containing said sample and said mixing implement into a suitably configured and sized centrifuge rotor, and centrifuging and fractionating said sample; wherein during centrifugation said mixing implement sheds any sedimenting solid material contained in said sample which said solid material may be propelled onto said mixing implement during centrifugation.

3. The method of claim 1 wherein after said placing step, said vessel is sealed using a closure selected from the group consisting of a hinged lid, a screw cap, a plug seal, and a flexible covering material.

4. The method of claim 1 wherein said straight wand-shaped mixing implement is formed from a material selected from the group consisting of a thermoplastic resin, glass, metal, and composite resin, wherein said material provides sufficient rigidity and strength so that said mixing implement remains intact and undeformed during said vortex mixing.

5. The method of claim 4 wherein said material is a thermoplastic resin selected from the group consisting of polyolefin, polycarbonate, polystyrene, acrylic, and polyester.

6. The method of claim 5 wherein said thermoplastic resin is a polyolefin selected from the group consisting of polypropylene and high density polyethylene.

7. The method of claim 1 or claim 2, further comprising selecting a cross-sectional shape for said straight wand-shaped mixing implement, wherein said straight wand-shaped mixing implement has a cross-sectional shape selected from the group consisting of round, oval, triangular, square, and polygon, and wherein said cross-sectional shape is selected to produce a desired level of turbulence and wall-scraping effect during said vortex-mixing.

8. The method of claim 1 or claim 2 wherein said straight wand-shaped implement is between approximately 0.5 and 1.5 inches long for use in a microcentrifuge tube whose maximum inner diameter is approximately 0.4 inch and whose maximum inner height is approximately 1.6 inches, thereby maintaining said straight wand-shaped implement in a substantially upright position and allowing longitutinal movement of said straight wand-shaped implement during said vortex-mixing.

9. The method of claim 1 or claim 2 further comprising the step of removing said straight wand-shaped mixing implement from said vessel, wherein said removing employs an extraction device adapted to allow removal of said straight wand-shaped implement while preventing contamination of said liquid or substantial disturbance of solid material sedimented during said centrifugation.

10. The method of claim 9, wherein said preventing contamination comprises preventing contamination of said sample with foreign microbes, and wherein said removing comprises providing a clean, sterile extraction device adapted to allow aseptic removal of said straight wand-shaped mixing implement from said vessel.

11. The method of claim 9 wherein said removing comprises extracting said mixing implement with a device selected from the group consisting of straight pin, other sharp object, and a hollow plastic straw.

12. The method of claim 9 wherein said removing comprises attracting said mixing implement by magnetic attraction, wherein said extraction device is a magnet and said mixing implement contains a ferromagnetic material.

13. The method of claim 1 wherein the length of said mixing implement is between 50% and 95% of the maximum inner height of said vessel when sealed, thereby maintaining said straight wand-shaped implement in a substantially upright position and allowing longitutinal movement of said straight wand-shaped implement during said vortex-mixing.

14. The method of claim 1 wherein the volume of said straight wand-shaped implement does not exceed 20% of the volume of said vessel, thereby providing efficient speed and mobility for the movement of said implement during said vortex mixing.

15. The method of claim 1 wherein the volume of said straight wand-shaped implement is less than 10% of the volume of said vessel, thereby providing efficient speed and mobility for the movement of said implement during said vortex mixing.

16. A microcentrifuge tube or sample vessel comprising therein a straight wand shaped mixing implement, wherein the length of said mixing implement is greater than the maximum inner diameter of said vessel but less than the maximum inner height of said vessel when sealed, so that said mixing implement is constrained to remain substantially upright within said vessel, and wherein the surface of said mixing implement is configured and arranged to be free of substantial depressions and concave blemishes which could trap sedimenting solid material contained in said sample during centrifugation.

17. A kit for improving the efficacy of vortex mixing a sample comprising a liquid, and not interfering with subsequent centrifugation of said sample, wherein a mixing implement and said sample are placed inside a microcentrifuge tube or sample vessel, and wherein following vortex-mixing of said sample, the presence of said mixing implement in said vessel does not substantially interfere with fractionation of said sample by centrifugation, said kit comprising a microcentrifuge tube or sample vessel and a straight wand shaped mixing implement, wherein the length of said mixing implement is greater than the maximum inner diameter of said vessel but less than the maximum inner height of said vessel when sealed, so that said mixing implement is constrained to remain substantially upright within said vessel, and wherein the surface of said mixing implement is configured and arranged to be free of substantial depressions and concave blemishes which could trap sedimenting solid material contained in a sample during centrifugation.

18. The tube or kit of claim 16 or 17, wherein the length of said mixing implement is between 50% and 95% of the maximum inner height of said tube when sealed.

19. The tube or kit of claim 16 or 17, wherein the volume of said straight wand-shaped implement does not exceed 20% of the volume of said tube.

* * * * *